US006392394B1

(12) United States Patent
Nakagawa et al.

(10) Patent No.: US 6,392,394 B1
(45) Date of Patent: May 21, 2002

(54) STEP-DOWN CIRCUIT FOR REDUCING AN EXTERNAL SUPPLY VOLTAGE

(75) Inventors: Atsushi Nakagawa; Hiroyuki Takahashi, both of Tokyo (JP)

(73) Assignee: NEC Corporation, Tokyo (JP)

( * ) Notice: Subject to any disclaimer, the term of this patent is extended or adjusted under 35 U.S.C. 154(b) by 0 days.

(21) Appl. No.: 09/718,212

(22) Filed: Nov. 21, 2000

(30) Foreign Application Priority Data

Nov. 25, 1999 (JP) ..... 11-334427

(51) Int. Cl.[7] ..... G05F 3/16; G05F 3/20
(52) U.S. Cl. ..... 323/315; 323/313; 323/317
(58) Field of Search ..... 323/313, 314, 323/315, 316, 317

(56) References Cited

U.S. PATENT DOCUMENTS 4,990,847 A * 2/1991 Ishimaru et al. ..... 323/314
5,189,316 A * 2/1993 Murakami et al. ..... 307/296.1
5,506,495 A * 4/1996 Uchida ..... 323/315
5,757,226 A * 5/1998 Yamada et al. ..... 327/541
5,861,771 A * 1/1999 Matsuda et al. ..... 327/540
5,990,671 A * 11/1999 Nagata ..... 323/313
6,005,379 A * 12/1999 Wong et al. ..... 323/313
6,064,188 A * 5/2000 Takashima et al. ..... 323/316

FOREIGN PATENT DOCUMENTS

JP 11-45947 2/1999

* cited by examiner

*Primary Examiner*—Bao Q. Vu
(74) *Attorney, Agent, or Firm*—Katten Muchin Zavis Rosenman

(57) ABSTRACT

A step-down circuit according to the present invention for reducing external supply voltage to be supplied from the outside to supply it to the internal circuit is provided with a diode circuit for reducing the external supply voltage by desired voltage to output it as the internal supply voltage, a pull-down transistor for pulling down the internal supply voltage to be outputted from the diode circuit when the external supply voltage drops, and a controlling circuit for controlling the operation of the pull-down transistor.

10 Claims, 6 Drawing Sheets

STEP-DOWN CIRCUIT FOR REDUCING AN EXTERNAL SUPPLY VOLTAGE

BACKGROUND OF THE INVENTION

1. Field of the Invention

The present invention relates to a step-down circuit, and more particularly to a step-down circuit for reducing external supply voltage to be supplied from the outside to supply it to an internal circuit.

2. Description of the Prior Art

In recent years, in a semiconductor integrated circuit device such as a semiconductor storage, external supply voltage VEX to be supplied from the outside is not only used as it is, but also is reduced or raised to generate predetermined internal supply voltage VCC for supplying to internal circuits necessitating it respectively to thereby reduce power consumption and improve reliability of elements.

A step-down circuit for generating internal supply voltage (step-down voltage) VCC by reducing external supply voltage VEX is used to protect so as to prevent any voltage which exceeds gate withstand voltage of a transistor, which is a component of the internal circuit, from being applied, and is generally constituted by a reference voltage generating circuit for generating predetermined reference voltage, a comparator for comparing the reference voltage with the internal supply voltage, which is output voltage, to control such that they coincide with each other, and an output transistor for supplying the internal supply voltage VCC to the internal circuit.

Since, however, it has been requested for the semiconductor integrated circuit device in recent years to further reduce consumption current for the entire device, it is desirable to reduce also consumption current in the step-down circuit. However, in a comparator (amplifier) for use in the step-down circuit, it is generally necessary to flow steady state current of several tens or more of VA in an operational state, and therefore, it is difficult to reduce the consumption current.

In order to comply with such a request, for example, technique for reducing consumption current by stopping the operation of the step-down circuit during standby of a semiconductor storage has been proposed in Japanese Patent Laid-Open Application No. 11-45947. FIG. 12 shows the circuit disclosed in this Japanese Patent Laid-Open Application No. 11-45947.

FIG. 12 is a circuit diagram showing the structure of a conventional step-down circuit.

As shown in FIG. 12, the semiconductor storage disclosed in the Japanese Patent Laid-Open Application No. 11-45947 is constituted by a step-down circuit 2 for reducing external supply voltage VEX to be supplied from the outside to supply it to an internal circuit 1 as the internal supply voltage VCC, and a diode circuit 3 to be inserted between the external power supply and a power supply terminal of the internal circuit 1, for reducing the external supply voltage VEX by the use of a diode.

An operation/non-operation of the step-down circuit 2 is controlled through a chip select signal CS to be supplied from the outside. The diode circuit 3 is constituted by a plurality of diodes (D11 and D12 in FIG. 12) connected in a forward direction from the external power supply toward the internal circuit 1 such that voltage equal to the internal supply voltage VCC to be outputted from the step-down circuit 2 is supplied to the internal circuit 1 by voltage drop caused by forward voltage of each diode.

In such structure, when the semiconductor storage to be mounted with the circuit shown in FIG. 12 is in a standby state, the chip select signal CS is negated (set to high level) by a controlling device not shown, and the step-down circuit 2 is set to a non-operational state to supply necessary electric power to the internal circuit 1 through the diode circuit 3.

On the other hand, when the semiconductor storage is in an ordinary operational state, the chip select signal CS is asserted (set to low level), and the step-down circuit 2 is set to an operational state to supply necessary electric power to the internal circuit 1 through the step-down circuit 2.

As described above, the operation of the step-down circuit 2 is caused to be stopped during standby, and necessary electric power is supplied to the internal circuit 1 from the external power supply through the diodes to thereby reduce the consumption current in the semiconductor storage during standby.

The external supply voltage VEX to be supplied to any semiconductor IC packaged on a printed board fluctuates by current flowing through other semiconductor IC and the like packaged on the same printed board (hereinafter, referred to as power supply vamp).

Of such conventional step-down circuits as described above, the step-down circuit shown in FIG. 12 is constructed so as to supply the internal supply voltage VCC to the internal circuit through the diodes during standby, and therefore, when the power supply vamp raises the external supply voltage VEX, voltage thus raised by the power supply vamp is also applied to the internal circuit in addition to the step-down voltage. Since generally consumption current through the internal circuit during standby is much less, when the external supply voltage VEX is raised by the power supply vamp during standby, the internal supply voltage VCC to be applied to the internal circuit will be maintained at voltage raised by the capacitance of the power supply line and the load capacitance as it is for many hours even if the external supply voltage VEX drops thereafter. Also, at this time, even if the semiconductor storage is shifted from the standby state to the operational state, some time is required for the step-down circuit to output predetermined step-down voltage, and therefore, higher voltage than the step-down voltage will be continuously applied during that period of time.

Therefore, since higher voltage than the step-down voltage is applied for many hours, the insulating performance of the gate oxide of the transistor, which is a component of the internal circuit, might be deteriorated to thereby worsen the transistor characteristics.

On the other hand, in a step-down circuit constituted by the reference voltage generating circuit, the comparator and the output transistor, since it is necessary to flow steady state current of several tens or more of $\mu$A through the comparator as described above, it is difficult to reduce the consumption current.

BRIEF SUMMARY OF THE INVENTION

Objects of the Invention

It is an object of the present invention to provide a step-down circuit capable of preventing the characteristics of the transistors within the internal circuit from being deteriorated by application of higher voltage than the step-down voltage for many hours, and reducing consumption current through the internal circuit.

SUMMARY OF THE INVENTION

A step-down circuit according to the present invention for reducing external supply voltage to be supplied from the outside to supply it to the internal circuit is provided with a diode circuit for reducing the external supply voltage by desired voltage to output it as the internal supply voltage, a pull-down transistor for pulling down the internal supply voltage to be outputted from the diode circuit when the external supply voltage drops, and a controlling circuit for controlling the operation of the pull-down transistor.

BRIEF DESCRIPTION OF THE DRAWINGS

The above-mentioned and other objects, features and advantages of this invention will become more apparent by reference to the following detailed description of the invention taken in conjunction with the accompanying drawings, wherein.

DETAILED DESCRIPTION OF THE INVENTION

Hereinafter, with reference to the drawings, the description will be made of embodiments according to the present invention.

Figure 1:
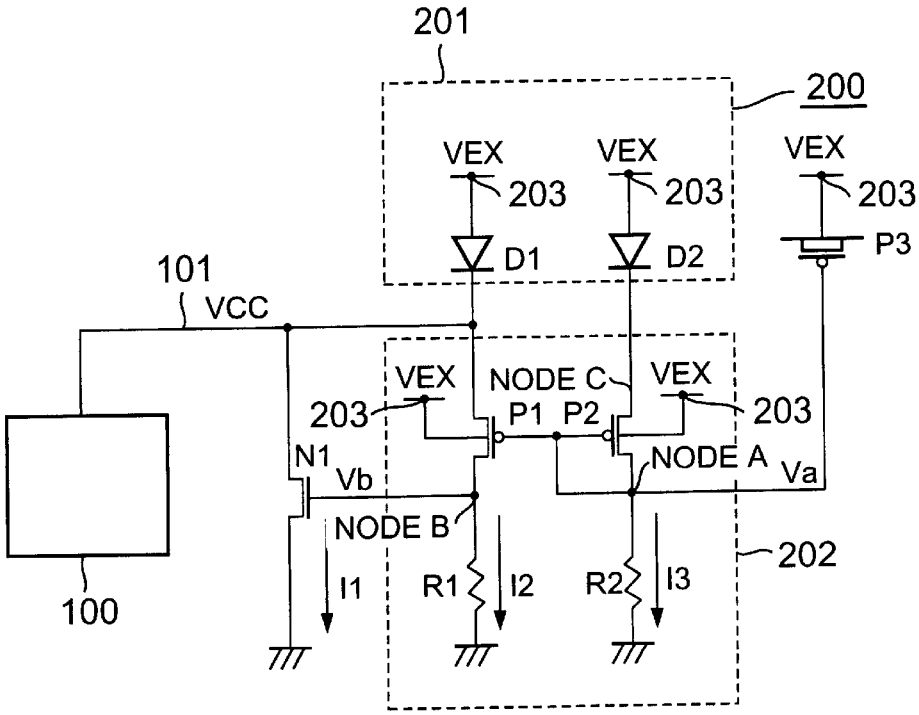
FIG. 1 is a circuit diagram showing the structure of a step-down circuit according to a first embodiment of the present invention.

FIG. 1 is a circuit diagram showing the structure of a step-down circuit according to the first embodiment of the present invention.

In FIG. 1, a step-down circuit 200 according to the present embodiment is constituted by: a diode circuit 201 for supplying internal supply voltage VCC to an internal circuit 100; a current mirror circuit 202 for detecting fluctuations in external supply voltage VEX; a P-channel MOSFET (hereinafter, all P-channel MOSFETs will be referred to as "PMOS transistor") P3, which is transistor capacitance; and a N-channel MOSFET (hereinafter, all N-channel MOSFETs will be referred to as "NMOS transistor") N1 for pulling down the internal supply voltage VCC when the external supply voltage VEX fluctuates. In this respect, a capacitor may be provided in place of the PMOS transistor P3.

A drain of the NMOS transistor N1 is connected to a power supply line 101 of the internal circuit 100, and a source thereof is connected to a grounding potential. A gate of the NMOS transistor N1 is connected to a cathode of a diode D1 of a diode circuit to be described later.

A current mirror circuit 202 is constituted by: PMOS transistors P1 and P2, whose substrate terminals are connected to the external power supply 203 respectively and whose gates are connected in common; a resistor R1, one end of which is connected to the drain of the PMOS transistor P1 and the gate of the NMOS transistor N1, the other end of which is connected to the grounding potential; and a resistor R2, one end of which is connected to the drain of the PMOS transistor P2, and the other end of which is connected to the grounding potential. In this respect, the PMOS transistor P3 is inserted between the external power supply 203 and the drain of the PMOS transistor P2. The gate and drain of the PMOS transistor P2 are connected in common, and the current mirror circuit 202 operates such that current flowing through the PMOS transistor P1 becomes equal to current flowing through the PMOS transistor P2.

A diode circuit 201 has diodes D1 and D2 which are inserted between the external power supply 203 and the current mirror circuit 202, the anode of the diode D1 is connected to the external power supply 203, and the cathode thereof is connected to the source of the PMOS transistor P1 within the current mirror circuit 202, the drain of the NMOS transistor N1, and the power supply line 101 of the internal circuit 100 respectively. Also, the anode of the diode D2 is connected to the external power supply 203, and the cathode thereof is connected to the source of the PMOS transistor P2 within the current mirror circuit 202.

In such structure, with reference to FIGS. 2 and 3, the description will be made of the operation of the step-down circuit according to the present embodiment.

Figure 2:
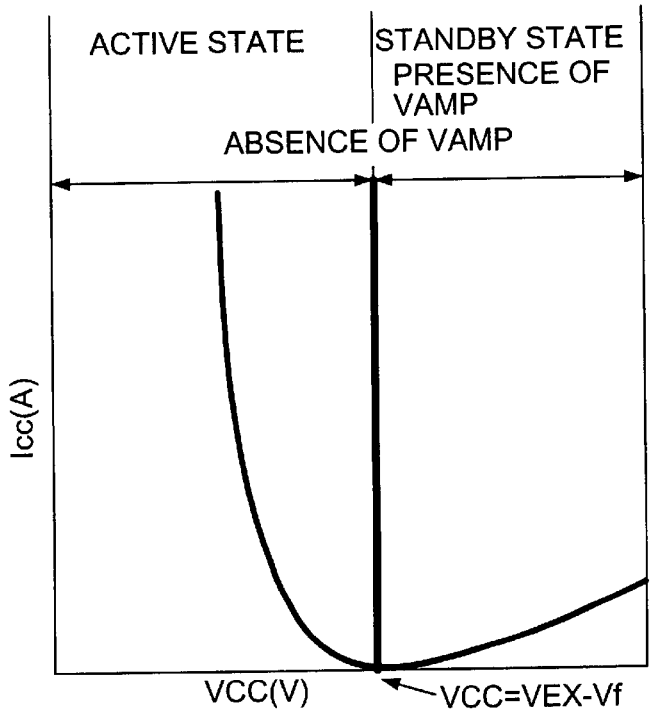
FIG. 2 is a graph showing variations in consumption current Icc through an internal circuit corresponding to variations in the internal supply voltage VCC to be supplied by the step-down circuit shown in FIG. 1.
Figure 3:
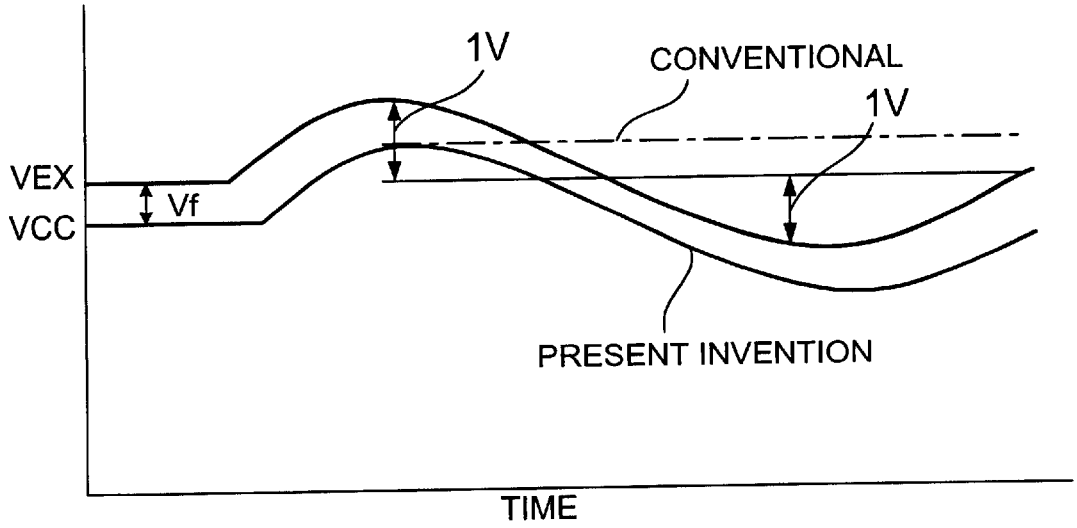
FIG. 3 is a graph showing variations in the internal supply voltage VCC corresponding to variations in the external supply voltage VEX to be supplied to the step-down circuit shown in FIG. 1.

FIG. 2 is a graph showing variations in consumption current Icc through an internal circuit corresponding to variations in the internal supply voltage VCC to be supplied by the step-down circuit shown in FIG. 1, and FIG. 3 is a graph showing variations in the internal supply voltage VCC corresponding to variations in the external supply voltage VEX to be supplied to the step-down circuit shown in FIG. 1. In this respect, the graph of FIG. 3 shows a state of the variations in the internal supply voltage VCC when the external supply voltage VEX fluctuates ±1 V in a standby state.

The internal circuit 100 has two states: an active state (ordinary operational state) and a standby state, and as shown in FIG. 2, in the active state, the operation is mainly performed at VCC=VEX−Vf or less, and in the standby state, the operation is mainly performed at more than VCC=VEX−Vf. In this respect, since the internal power supply is susceptible to the power supply vamp in the standby state as described above, this will be considered by dividing into two cases: absence of power supply vamp and presence of power supply vamp.

The active state means that the internal circuit 100 is in an ordinary operational state, and power current flows through the internal circuit 100, whereby the internal supply voltage VCC to be outputted from the step-down circuit 200 transitions in a direction (left side in FIG. 2) to drop. However, electric power is supplied from the external power supply 203 through the diode D1, and the internal supply voltage VCC is maintained at voltage obtained by deducting only forward voltage Vf of the diode D1 from the external supply voltage VEX. In this respect, at this time, the internal supply voltage VCC becomes comparatively stable voltage because of wire capacitance of the power supply line 101 and load capacitance of transistors within the internal circuit 100.

On the other hand, the standby state is a state in which the memory cell and the like are not accessed, and for example, in the case of SRAM and the like, only holding current for storing information flows in trace amounts (several $\mu$A). In this state, power current for flowing through the internal circuit 100 is much less than in the active state, but basically, the internal supply voltage VCC of VEX−Vf is applied in the same manner as in the active state.

First, the description will be made of consumption current through the step-down circuit according to the present embodiment in the active state and standby state (absence of power supply vamp).

As current for flowing through the step-down circuit 200 shown in FIG. 1, there are current I1 for flowing through the drain-source of the NMOS transistor N1 through the diode D1, current I2 for flowing through the diode D1, the drain-source of the PMOS transistor P1 and the resistor R1, and current I3 for flowing through the diode D2, the drain-source of the PMOS transistor P2, and the resistor R2.

In this case, assuming sub-threshold voltage (threshold voltage) of the PMOS transistor P1 to be Vt1 and sub-threshold voltage of the PMOS transistor P2 to be Vt2, in the present embodiment, an impurity injection rate to a channel area of the transistor is changed to set so as to satisfy the relationship of Vt1>VT2, and in the absence of the power supply vamp, the setting is made such that the PMOS transistor P1 does not turn on.

If the PMOS transistor P1 does not turn on, no current I2 will flow, and therefore, the drain (node B) of the PMOS transistor P1 becomes 0[V]. Also, if the node B is at 0[V], the NMOS transistor N1 will not turn on, and therefore, no current I1 flows either.

The sub-threshold voltage at the PMOS transistors P1 and P2 is set so as to satisfy a relationship of Vt1>Vt2 as described above, whereby I1=I2=0[mA] is given, and therefore, the consumption current through the step-down current 200 becomes only I3.

Since the current I3 is caused to flow only to monitor the fluctuation in the external supply voltage VEX, the resistor R2 can be set to a very high resistance value. If the resistor R2 is set to, for example, $1\times10^7$(10M) [Ω], I3=(VEX−Vf)/R2=0.26 [$\mu$A]<1[$\mu$A] will be given assuming the external supply voltage VEX to be 3.3[V], and Vf to be 0.7[V].

Therefore, in the active state and in the standby state free from power supply vamp, current flowing through the step-down circuit can be set to 1[$\mu$A] or less, and therefore, consumption current through the step-down circuit can be reduced by a large amount.

Next, the description will be made of consumption current through the step-down circuit 200 according to the present embodiment in the standby state in which the power supply vamp occurs.

Figure 12:
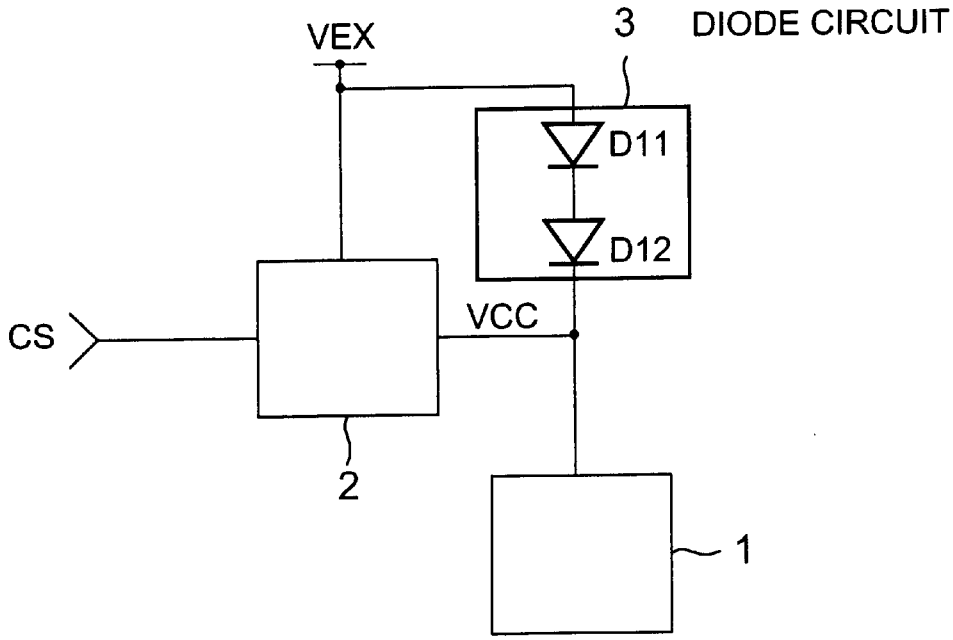
FIG. 12 is a circuit diagram showing the structure of a conventional step-down circuit.

In the conventional step-down circuit shown in FIG. 12, when the external supply voltage VEX rises by 1[V], the internal supply voltage VCC also follows it to rise by 1[V]. Also, as described above, the internal supply voltage VCC thus raised remains as it is even if the external supply voltage VEX drops. In this case, higher voltage than the external supply voltage VEX will be applied to the internal circuit for many hours.

In contrast, in the step-down circuit 200 according to the present embodiment, when the external supply voltage VEX rises, the internal supply voltage VCC also rises as in the conventional case, but when the external supply voltage VEX drops, the NMOS transistor N1 turns on to thereby drop the internal supply voltage VCC. Thereby, the relationship of VCC=VEX−Vf is maintained even when the power supply vamp occurs (See FIG. 3). The detailed description will be made of the operation of the step-down circuit 200 when this external supply voltage VEX drops.

When the voltage of the external supply voltage VEX in the initial state is set to, for example, 3.3[V], the source potential VCC of the PMOS transistors P1 and P2 is VCC=VEX(3.3[V])−Vf (0.7[V])=2.6[V].

The potential Va at the node A (drain of the PMOS transistor P2) is Va=VEX−Vf−Vt2=2.6[V]−Vt2.

From these relationships, the gate-source voltage Vgs (VCC-potential Va at node A) of the PMOS transistor P1 becomes Vgs=Vt2.

In the present embodiment, since the sub-threshold voltage Vt1 of the PMOS transistor P1 and the sub-threshold voltage Vt2 of the PMOS transistor P2 are set to satisfy the relationship of Vt1>Vt2 so as to prevent the PMOS transistor P1 from turning on, the voltage at the node B (drain of the PMOS transistor P1) is 0[V].

On the other hand, when the external supply voltage VEX drops by 1[V] (when it changes from 3.3[V] to 2.3[V]), the potential Va at the node A drops from 2.6[V]−Vt2 to 1.6[V]−Vt2 through the transistor capacitance including the PMOS transistor P3.

Therefore, the gate-source voltage Vgs of the PMOS transistor P1 rises to Vgs=Vt2+1[V], and therefore if the sub-threshold voltage of the PMOS transistors P1 and P2 satisfies the relationship of Vt2+1[V]>Vt1>Vt2, the PMOS transistor P1 will turn on, and the current I2 will flow to raise the potential Vb at the node B. When the potential Vb at the node B rises, the NMOS transistor N1 turns on, and therefore, the current I1 flows to cause the internal supply voltage VCC to transition in a direction to drop.

When the internal supply voltage VCC drops, the gate-source voltage Vgs of the PMOS transistor P1 returns from Vt2+1[V] to Vt2, and therefore, the potential at the node B gradually drops up to the grounding potential, and the current through the NMOS transistor N1 gradually decreases. Thus, when the potential at the node B reaches the grounding potential, the NMOS transistor N1 turns off. These series of operations cause the internal supply voltage VCC to drop up to VCC=VEX(2.3[V])−Vf(0.7[V])=1.6[V].

As described above, the fluctuations in the external supply voltage VEX are monitored by the use of the current mirror circuit 202 and the transistor capacitance, whereby even if the external supply voltage VEX fluctuates by the power supply vamp, the internal supply voltage VCC follows it to change.

In the step-down circuit 200 according to the present embodiment, therefore, higher voltage than the step-down voltage is applied to the internal circuit 100 as in the conventional case, but since the higher voltage will not be applied for many hours, the insulating performance of the gate oxide of the transistor within the internal circuit 100 is not deteriorated, but the transistor characteristics can be prevented from being worsened.

Next, with reference to the drawings, the description will be made of a step-down circuit according to a second embodiment of the present invention.

Figure 4:
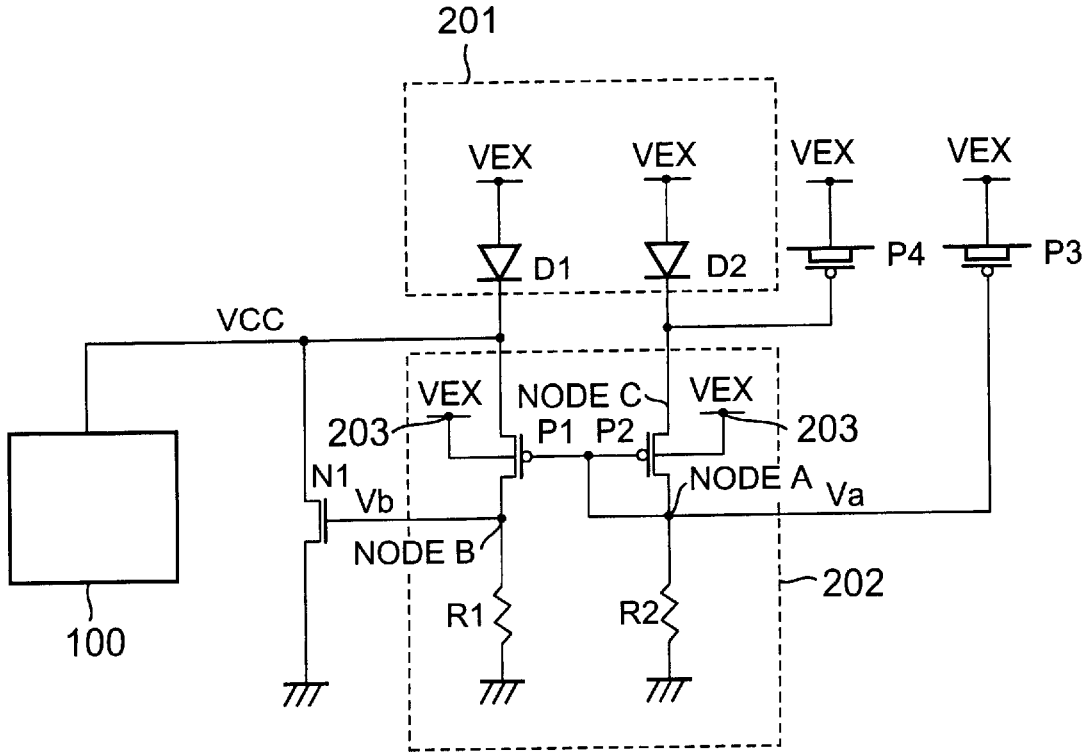
FIG. 4 is a circuit diagram showing the structure of a step-down circuit according to a second embodiment of the present invention.

FIG. 4 is a circuit diagram showing structure of the step-down circuit according to a second embodiment of the present invention.

As shown in FIG. 4, the step-down circuit according to the present embodiment is different from the first embodiment in that a PMOS transistor P4, which is transistor capacitance, is provided between a source (node C) of a PMOS transistor P2 within the current mirror circuit and the external power supply. Since it is the same as the first embodiment in other structure, the description thereof will be omitted.

As described above, transistor capacitance is provided not only between the node A (drain of the PMOS transistor P2) and the external power supply, but also between the node C and the external power supply, whereby fluctuations in the external supply voltage VEX can be more accurately monitored.

Therefore, the follow-up property of the internal supply voltage VCC to the power supply vamp of the external supply voltage VEX can be improved more than in the first embodiment.

Next, with reference to the drawings, the description will be made of the step-down circuit according to a third embodiment of the present invention.

Figure 5:
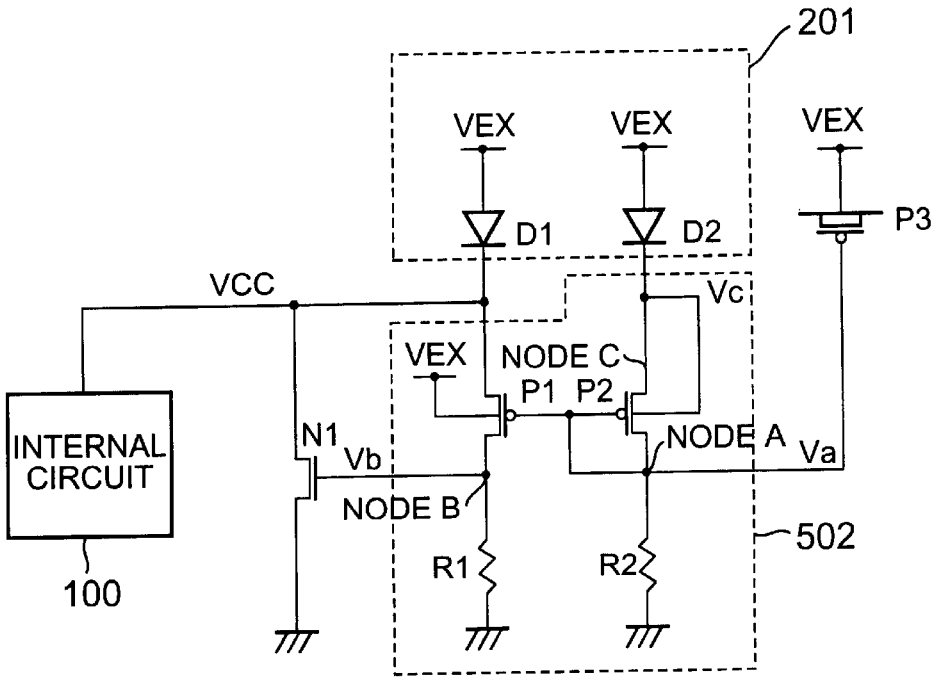
FIG. 5 is a circuit diagram showing the structure of a step-down circuit according to a third embodiment of the present invention.

FIG. 5 is a circuit diagram showing structure of the step-down circuit according to the third embodiment of the present invention.

As shown in FIG. 5, the step-down circuit according to the present embodiment is different from that of the first embodiment in that the substrate terminal of the PMOS transistor P2, which is a component of the current mirror circuit, is connected to the source thereof. Since it is the same as the first embodiment in other structure, the description thereof will be omitted.

It is not desirable that steady state current flows through the PMOS transistor P1 in a state in which no power supply vamp occurs because it increases consumption current through the step-down current. In the first embodiment, therefore, the sub-threshold voltage of the PMOS transistors P1 and P2 is set to satisfy the relationship of $Vt1>Vt2$, whereby the PMOS transistor P1 has been set so as to prevent it from turning on in the absence of the power supply vamp.

In the present embodiment, as a contrivance to more reliably prevent the PMOS transistor P1 from turning on in the absence of the power supply vamp, the substrate terminal of the PMOS transistor P2 is connected to the source (node C) thereof.

When the node C and the substrate terminal are at the same potential, the influence of the bias effect on the substrate is lost, and therefore, the sub-threshold voltage $Vt2$ drops as compared with when the substrate terminal is connected to the external power supply. Thereby, the PMOS transistor P1 is more reliably prevented from turning on than in the first embodiment.

Next, with reference to the drawings, the description will be made of the step-down circuit according to a fourth embodiment of the present invention.

Figure 6:
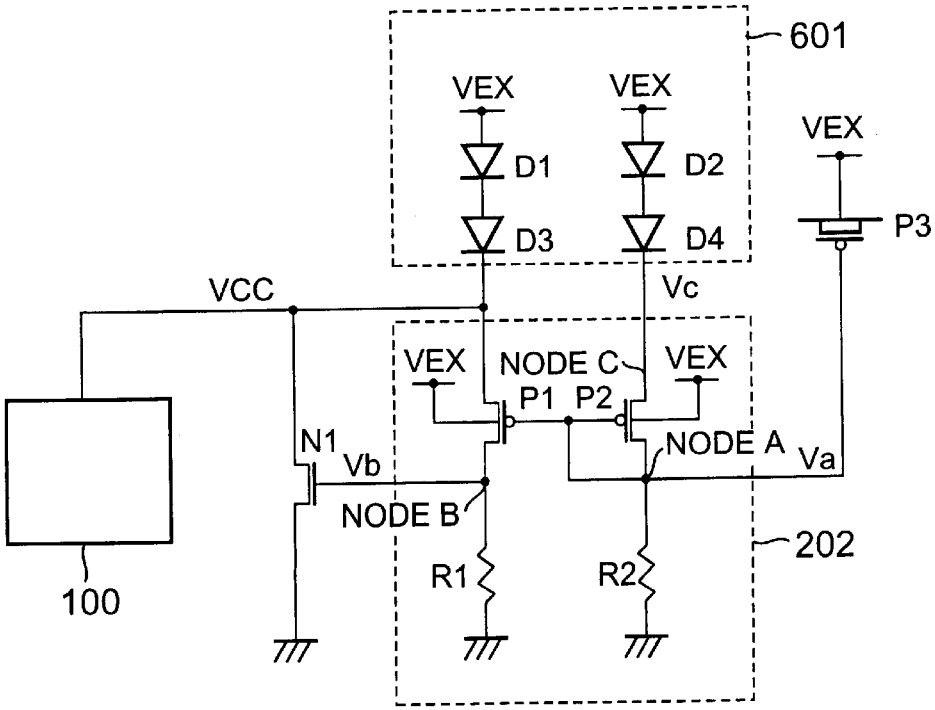
FIG. 6 is a circuit diagram showing the structure of a step-down circuit according to a fourth embodiment of the present invention.

FIG. 6 is a circuit diagram showing structure of the step-down circuit according to the fourth embodiment of the present invention.

As shown in FIG. 6, the step-down circuit according to the present embodiment is different from that of the first embodiment in that a diode D3 is connected in series to the diode D1, which is a component of the diode circuit, and a diode D4 is connected in series to the diode D2. Since it is the same as the first embodiment in other structure, the description thereof will be omitted.

When forward voltage of the diodes D1 and D3 shown in FIG. 6 is assumed to be Vf respectively, the internal supply voltage VCC becomes equal to $VCC=VEX-2Vf$. Since it is possible to acquire lower step-down voltage by increasing the number of diodes as described above, desired internal supply voltage VCC can be acquired without depending upon the external supply voltage VEX. In this respect, FIG. 6 shows the structure in which two diodes are connected in series, but more diodes can be connected.

Next, with reference to the drawings, the description will be made of the step-down circuit according to a fifth embodiment of the present invention.

Figure 7:
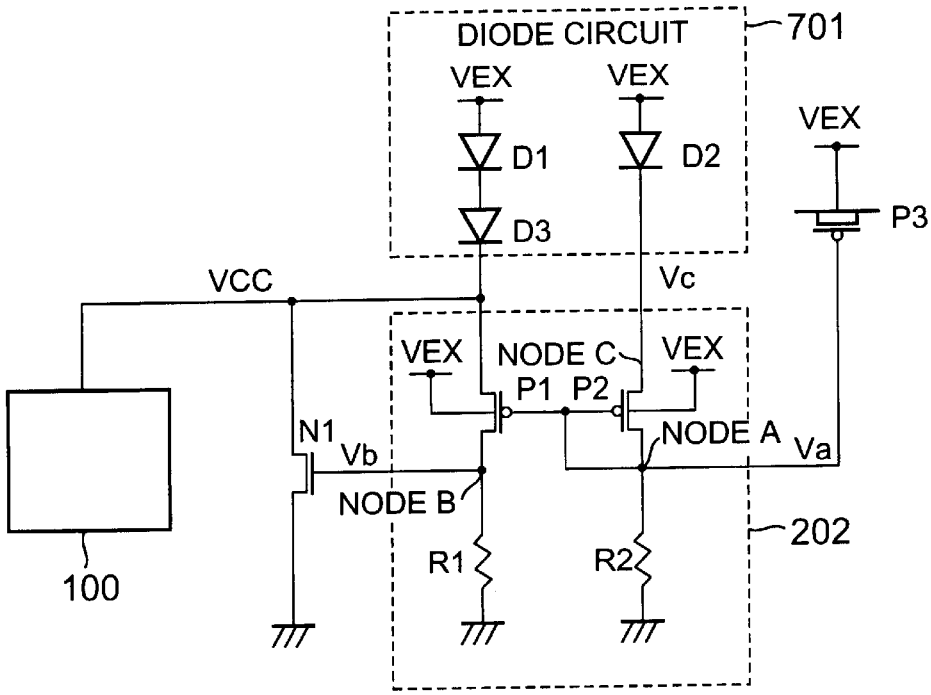
FIG. 7 is a circuit diagram showing the structure of a step-down circuit according to a fifth embodiment of the present invention.

FIG. 7 is a circuit diagram showing structure of the step-down circuit according to the fifth embodiment of the present invention.

As shown in FIG. 7, the step-down circuit according to the present embodiment is different from that of the first embodiment in that the diode D3 is connected in series only to the diode D1, which is a component of the diode circuit. Since it is the same as the first embodiment in other structure, the description thereof will be omitted.

In the third embodiment, the substrate terminal of the PMOS transistor P2 and the source thereof are connected to each other, whereby the PMOS transistor P1 is set to prevent it from turning on in the absence of the power supply vamp.

In the present embodiment, the PMOS transistor P1 is set to prevent it from turning on by increasing only the number of diodes to be connected in series to the source of the PMOS transistor P1.

In FIG. 7, the source potential VCC of the PMOS transistor P1 is $VCC=VEX-2Vf$. On the other hand, the source (node C) potential Vc of the PMOS transistor P2 is $Vc=VEX-Vf$. The drain (node A) potential Va of the PMOS transistor P2 is $Va=Vc-Vt2=VEX-Vf-Vt2$.

Therefore, the gate-source voltage Vgs of the PMOS transistor P1 is $Vgs=VCC-Va=-Vf+Vt2$, and the PMOS transistor P1 can be set to more reliably prevent it from turning on from the relationship of $Vt1>Vt2>Vgs(-Vf+Vt2)$.

In this respect, FIG. 7 shows the structure in which two diodes are connected in series to the source of the PMOS transistor P1 and one diode is connected to the source of the PMOS transistor P2, but any number of diodes can be used so long as the number of diodes to be connected in series to the PMOS transistor P1 is more than the number of diodes to be connected in series to the PMOS transistor P2. The structure may be arranged such that diodes are connected only to the PMOS transistor P1 while no diode is connected to the PMOS transistor P2.

Next, with reference to the drawings, the description will be made of the step-down circuit according to a sixth embodiment of the present invention.

Figure 8:
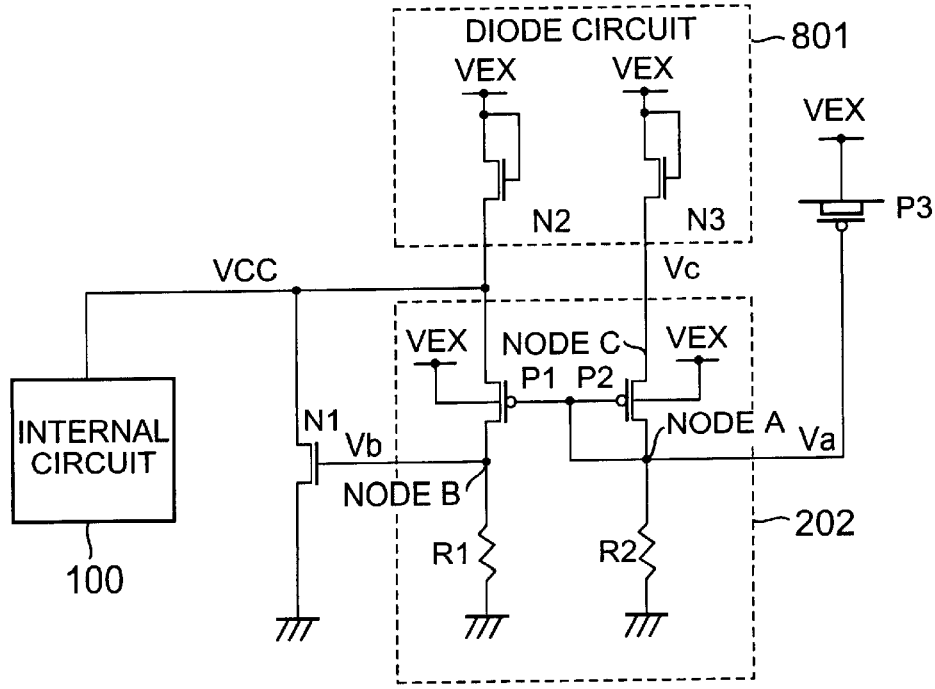
FIG. 8 is a circuit diagram showing the structure of a step-down circuit according to a sixth embodiment of the present invention.

FIG. 8 is a circuit diagram showing structure of the step-down circuit according to the sixth embodiment of the present invention.

As shown in FIG. 8, the step-down circuit according to the present embodiment is different from that of the first embodiment in that diode-connected (drain and gate are connected together) NMOS transistors N2 and N3 are provided in place of the diodes D1 and D2, which are components of the diode circuit. Since it is the same as the first embodiment in other structure, the description thereof will be omitted.

Even such structure is capable of obtaining the same effect as the first embodiment because the NMOS transistors N2 and N3 operate as the diode respectively.

Next, with reference to the drawings, the description will be made of the step-down circuit according to a seventh embodiment of the present invention.

Figure 9:
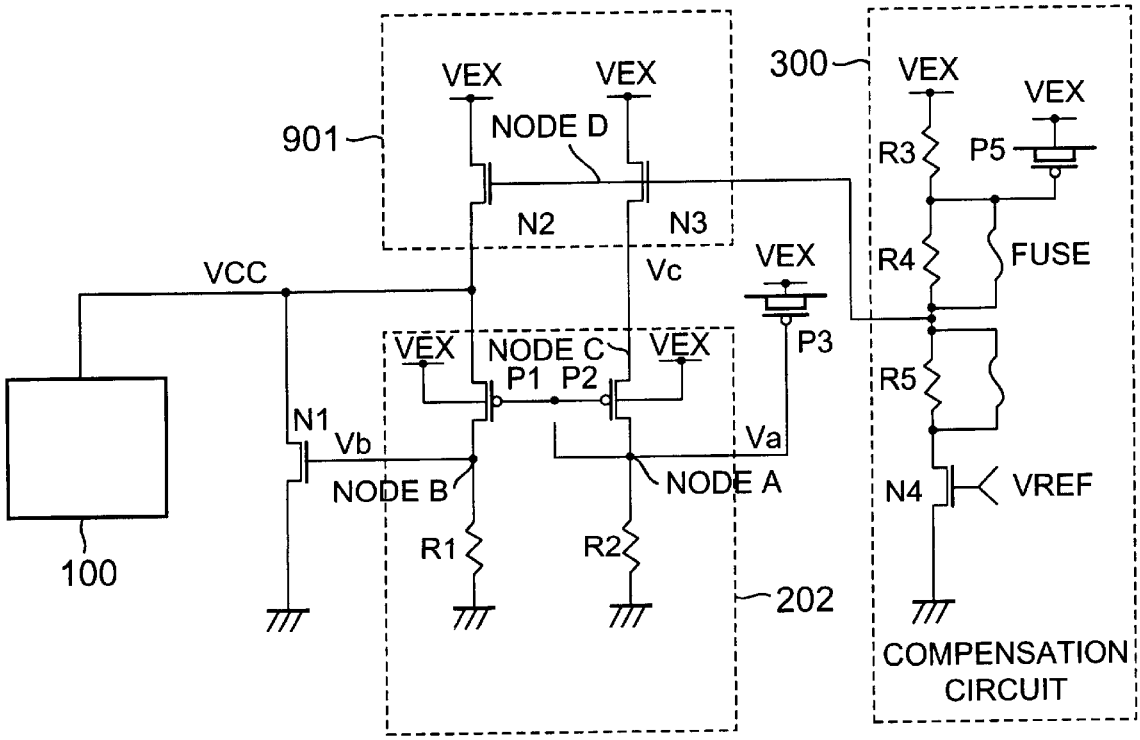
FIG. 9 is a circuit diagram showing the structure of a step-down circuit according to a seventh embodiment of the present invention.

FIG. 9 is a circuit diagram showing structure of the step-down circuit according to the seventh embodiment of the present invention.

In the fourth embodiment, the structure is arranged such that a plurality of diodes is connected in series in order to obtain lower step-down voltage. When the number of diodes is increased, however, an amount of change (temperature dependence) in forward voltage Vf corresponding to variations in ambient temperature becomes larger in proportion to the number of diodes. In other words, in the structure in which a plurality of diodes is connected in series to thereby obtain step-down voltage from the external supply voltage, it is difficult to obtain stable step-down voltage against variations in ambient temperature.

As shown in FIG. 9, the step-down circuit according to the present embodiment is constructed such that NMOS transistors N2 and N3 are provided respectively in place of the diodes D1 and D2, which are components of the diode circuit, and that there is provided a compensation circuit 300 for controlling the source-drain voltage of the NMOS transistors N2 and N3 constant.

The compensation circuit 300 is constituted by a plurality of resistors (resistors R3, R4 and R5 in FIG. 9) connected in series to be inserted between the external power supply and the grounding potential, a NMOS transistor N4 and a PMOS transistor P5, which is transistor capacitance. In this respect, the PMOS transistor P5 is inserted between a node of resistors R3 and R4, and the external power supply, and is used to control the gate voltage of the NMOS transistors N2 and N3 in response to variations in the external supply voltage VEX. Also, predetermined reference voltage VREF is applied to the gate of the NMOS transistor N4. Since it is the same as in the first embodiment in other structure, the description thereof will be omitted.

Figure 10:
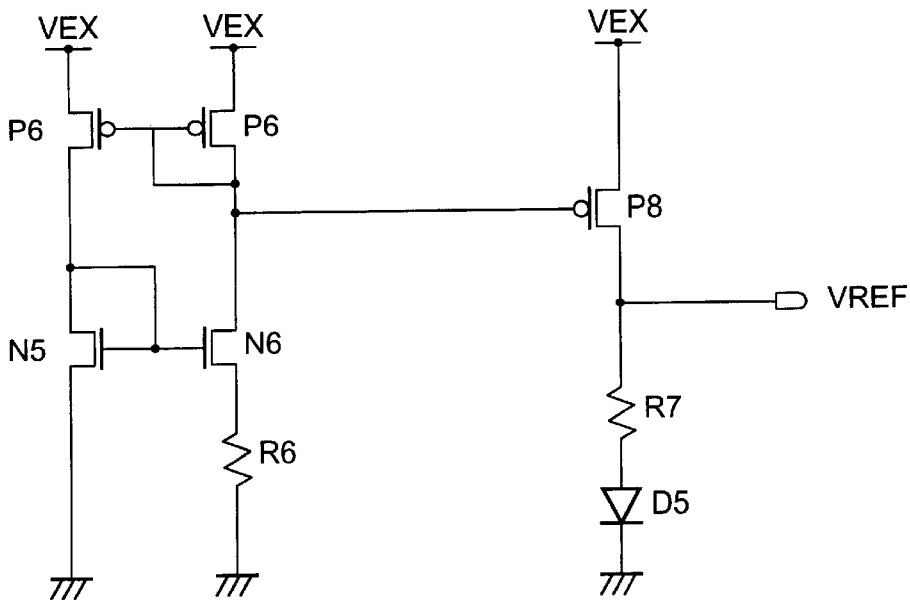
FIG. 10 is a circuit diagram showing a structural example of a circuit for generating reference voltage for supplying to the step-down circuit shown in FIG. 9.

In such structure, voltage Vd to be determined by a resistance ratio between the resistor R3 and the NMOS transistor N4 is applied to the gate (node D) of the NMOS transistor N2, N3. On-resistance of the NMOS transistor N4 is controlled by the reference voltage VREF, and a stable supply of the reference voltage VREF is ensured by a reference voltage generating circuit consisting of, for example, such a bandgap reference circuit as shown in FIG. 10.

In this case, the above described object will be attained if the temperature dependence of the reference voltage VREF is set so as to offset the temperature dependence of the NMOS transistors N2 and N3. In other words, the object of using the reference voltage VREF is to set the on-resistance of the NMOS transistor N4 to a desired value, and to offset the temperature dependence of the NMOS transistors N2 and N3.

Assuming the sub-threshold voltage of the NMOS transistor N2 to be Vtn, and a voltage drop in the resistor R3 to be Vr3, the internal supply voltage VCC becomes equal to VCC=VEX−Vr3−Vtn.

At this time, fine adjustment of the internal supply voltage VCC can be performed by adjusting the value of the voltage drop Vr3 of the resistor R3, and as shown in FIG. 9, a plurality of resistors R4 and R5 are connected in series to the resistor R3 in advance and fuses connected in parallel with the resistors R4 and R5 are cut off or are not cut off, whereby the setting can be easily made.

Next, with reference to the drawings, the description will be made of the step-down circuit according to an eighth embodiment of the present invention.

Figure 11:
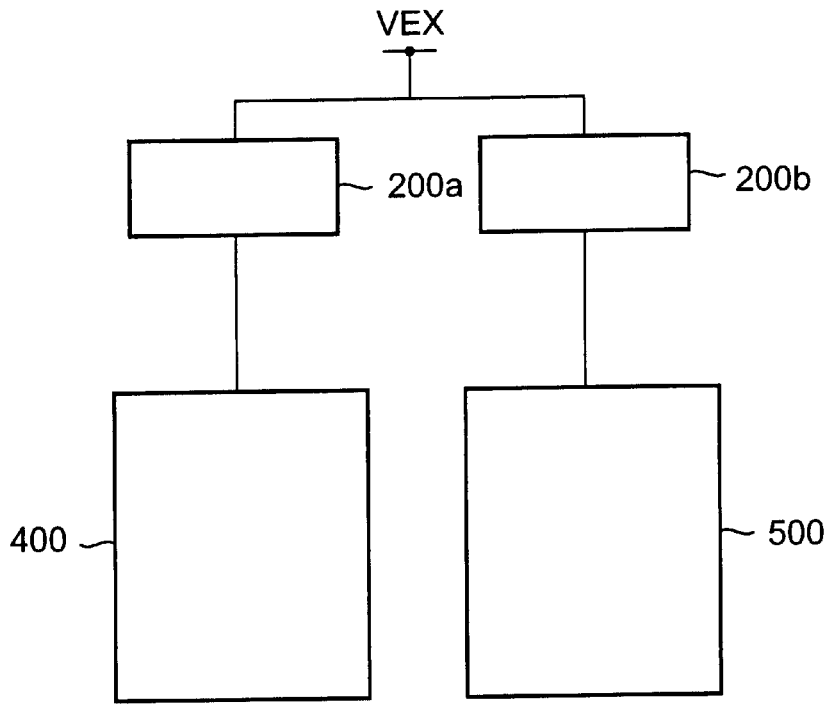
FIG. 11 is a circuit diagram showing the structure of a step-down circuit according to an eighth embodiment of the present invention.

FIG. 11 is a circuit diagram showing structure of the step-down circuit according to the eighth embodiment of the present invention.

In the present embodiment, the structure is, as shown in FIG. 11, arranged such that a memory cell 400 for storing information in the semiconductor storage and a peripheral circuit 500 for controlling the information are provided with step-down circuits 200*a* and 200*b* for supplying internal supply voltage respectively.

The structure of the step-down circuit 200*a* or 200*b* is the same as one shown in the above described first embodiment to seventh embodiment, and therefore, the description thereof will be omitted.

The memory cell 400 and the peripheral circuit 500 are provided with exclusive step-down circuits 200*a* and 200*b* respectively as described above, whereby an influence on the memory cell 400 by current for flowing through the peripheral circuit 500 can be restrained to a minimum.

In this respect, in the above described first embodiment to seventh embodiment, there has been shown an example of a circuit in which the current mirror circuit is constituted by the PMOS transistor, but in the structure in which resistors are provided on the external power supply side and transistors are provided on the grounding potential side, it is also possible to constitute by the NMOS transistor.

Also, in the above described first embodiment to seventh embodiment, there has been shown an example of the circuit in which positive internal supply voltage VCC is supplied to the internal circuit by using positive external supply voltage, but it is also possible to arrange the structure such that negative internal supply voltage is supplied to the internal circuit if the external power supply is changed to the grounding potential and the grounding potential is changed to negative external power supply.

Since it is constructed as described above, a step-down circuit according to the present invention can exhibit the following effects.

The step-down circuit is provided with a diode circuit for reducing the external supply voltage by desired voltage to output it as the internal supply voltage; a pull-down transistor for pulling down the internal supply voltage to be outputted from the diode circuit when the external supply voltage drops; and a controlling circuit for controlling the operation of the pull-down transistor, whereby when the external supply voltage drops, the internal supply voltage also follows it to drop. Therefore, higher voltage than the step-down voltage will not be applied to the internal circuit for many hours unlike the conventional step-down circuit.

Therefore, the insulating performance of the gate oxide of the transistor in the internal circuit will not be deteriorated, but the transistor characteristics will be prevented from being worsened.

The controlling circuit is constituted by a current mirror circuit and a capacitor to be inserted between the drain of the second transistor and the external power supply. The current mirror circuit has: a first transistor, to which internal supply voltage is applied; a second transistor, whose gate is connected in common to the first transistor and whose drain is connected to the gate; a first resistor to be connected in series to the first transistor; and a second resistor to be connected in series to the second transistor. Assuming that the sub-threshold voltage of the first transistor to be Vt1, and the sub-threshold voltage of the second transistor to be Vt2, the relationship of Vt1>Vt2 is caused to be satisfied; the external supply voltage is applied to the substrate terminal of the first transistor and the substrate terminal of the second transistor is connected to the source of the second transistor; or the diode circuit is provided with diodes to be connected in series to the first transistor and the second transistor in a forward direction from the external power supply toward the controlling circuit respectively in such a manner that the number of diodes to be connected in series to the first transistor is more than the number of diodes to be connected in series to the second transistor, whereby it is possible to reduce the current for flowing through the step-down circuit when the internal circuit is in the active state and the standby (absence of power supply vamp) state, and therefore the consumption current through the step-down circuit can be reduced.

Although the invention has been described with reference to specific embodiments, this description is not meant to be construed in a limiting sense. Various modifications of the disclosed embodiments will become apparent to persons skilled in the art upon reference to the description of the invention. It is therefore contemplated that the appended claims will cover any modifications or embodiments as fall within the true scope of the invention.

What is claimed is:

1. A step-down circuit for reducing external supply voltage to be supplied from the outside to supply it to an internal circuit, comprising:

a diode circuit for reducing said external supply voltage by desired voltage to output it as internal supply voltage;

a pull-down transistor for pulling down said internal supply voltage to be outputted from said diode circuit when said external supply voltage drops; and a controlling circuit for controlling an operation of said pull-down transistor, wherein said diode circuit has step-down transistors inserted between said external power supply and said controlling circuit, wherein said step-down circuit has a compensation circuit for controlling source-drain voltage of said step-down transistor to a desired value, and wherein said compensation circuit comprises compensation transistors to be inserted in series between said external power supply and grounding potential, to whose gates predetermined reference voltage is applied so as to provide such on-resistance as to offset temperature dependence of said step-down transistors, at least one resistor to be connected in series to said compensation transistors, and a capacitor to be inserted between connecting portions between said resistor and said compensation transistors, and said external power supply.

2. A step-down circuit according to claim 1, wherein said capacitor consists of transistor capacitance.

3. A step-down circuit for reducing external supply voltage to be supplied from the outside to supply it to an internal circuit, comprising:

a diode circuit for reducing said external supply voltage by desired voltage to output it as internal supply voltage;

a pull-down transistor for pulling down said internal supply voltage to be outputted from said diode circuit when said external supply voltage drops; and a controlling circuit for controlling an operation of said pull-down transistor, wherein said controlling circuit comprises:

a current mirror circuit having: a first transistor to which said internal supply voltage is applied; a second transistor whose gate is connected in common to that of said first transistor and whose drain is connected to said gate; a first resistor to be connected in series to said first transistor; and a second resistor to be connected in series to said second transistor; and a capacitor to be inserted between the drain of said second transistor and said external power supply.

4. A step-down circuit according to claim 3, wherein said capacitor consists of transistor capacitance.

5. A step-down circuit according to claim 3, wherein sub-threshold voltage of said first transistor is higher than sub-threshold voltage of said second transistor.

6. A step-down circuit according to claim 3, further comprising a second capacitor to be inserted between the source of said second transistor and said external power supply.

7. A step-down circuit according to claim 6, wherein said second capacitor consists of transistor capacitance.

8. A step-down circuit according to claim 3, wherein said external supply voltage is applied to substrate terminals of said first transistor and said second transistor respectively.

9. A step-down circuit according to claim 3, wherein said external supply voltage is applied to the substrate terminal of said first transistor and the substrate terminal of said second transistor is connected to the source of said second transistor.

10. A step-down circuit according to claim 3 wherein said diode circuit has diodes to be connected in series to said first transistor and said second transistor in a forward direction from said external power supply toward said controlling circuit, or at least diodes to be connected in series to said first transistor in such a manner that the number of diodes to be connected in series to said first transistor is more than the number of diodes to be connected in series to said second transistor.

* * * * *